US008947192B2

(12) United States Patent
Nohara

(10) Patent No.: US 8,947,192 B2
(45) Date of Patent: Feb. 3, 2015

(54) FUSIBLE LINK UNIT

(75) Inventor: Mami Nohara, Makinohara (JP)

(73) Assignee: Yazaki Corporation, Tokyo (JP)

( * ) Notice: Subject to any disclaimer, the term of this patent is extended or adjusted under 35 U.S.C. 154(b) by 350 days.

(21) Appl. No.: 13/511,748

(22) PCT Filed: Dec. 24, 2010

(86) PCT No.: PCT/JP2010/073885

§ 371 (c)(1),
(2), (4) Date: May 24, 2012

(87) PCT Pub. No.: WO2011/078415

PCT Pub. Date: Jun. 30, 2011

(65) Prior Publication Data

US 2012/0262267 A1 Oct. 18, 2012

(30) Foreign Application Priority Data

Dec. 24, 2009 (JP) ..... 2009-291749

(51) Int. Cl.

| | |
|---|---|
| ***H01H 85/02*** | (2006.01) |
| ***H01H 85/30*** | (2006.01) |
| ***H01H 85/044*** | (2006.01) |
| *H01H 85/20* | (2006.01) |

(52) U.S. Cl.

CPC ..... *H01H 85/044* (2013.01); *H01H 85/2045* (2013.01); *H01H 2085/025* (2013.01)

USPC ..... 337/186; 337/159; 337/206; 337/293

(58) Field of Classification Search

USPC ..... 337/159, 166, 186, 293, 206

See application file for complete search history.

(56) References Cited

U.S. PATENT DOCUMENTS

| | | | | |
|---|---|---|---|---|
| 6,294,978 | B1 | 9/2001 | Endo et al. | |
| 6,512,443 | B1 * | 1/2003 | Matsumura et al. | 337/189 |
| 6,566,599 | B2 * | 5/2003 | Sumida et al. | 174/50 |
| 6,568,954 | B2 * | 5/2003 | Endo et al. | 439/489 |
| 6,576,838 | B2 * | 6/2003 | Matsumura | 174/66 |
| 6,630,626 | B2 | 10/2003 | Johnson et al. | |
| 6,806,421 | B2 * | 10/2004 | Matsumura | 174/50 |
| 6,824,430 | B2 * | 11/2004 | Matsumura et al. | 439/620.29 |
| 7,025,624 | B2 * | 4/2006 | Kiyota et al. | 439/489 |

(Continued)

FOREIGN PATENT DOCUMENTS

| | | |
|---|---|---|
| DE | 4 441 281 A1 | 5/1996 |
| EP | 1124246 A2 | 8/2001 |

(Continued)

OTHER PUBLICATIONS

International Search Report dated Apr. 19, 2011 issued in International Application No. PCT/JP2010/073885 (PCT/ISA/210).

(Continued)

*Primary Examiner* — Anatoly Vortman
(74) *Attorney, Agent, or Firm* — Sughrue Mion, PLLC

(57) ABSTRACT

A fusible link unit includes a conductive bus-bar having a fusible portion, a resin housing molded integrally with the bus-bar and including a locking projection, and an exposing window portion for exposing the fusible portion, such that the resin cover is capable of being locked to the locking projection so as to cover the fusible portion, where a half-fitting prevention projection is provided at a periphery of the exposing window portion to prevent half-fitting while suppressing an increase in projection costs.

1 Claim, 5 Drawing Sheets

(56) References Cited

U.S. PATENT DOCUMENTS

| | | | |
|---|---|---|---|
| 2001/0011939 | A1 | 8/2001 | Inaba et al. |
| 2002/0163416 | A1 | 11/2002 | Matsumura |
| 2003/0222752 | A1 | 12/2003 | Ohashi et al. |

FOREIGN PATENT DOCUMENTS

| | | | |
|---|---|---|---|
| EP | 1255271 | A2 | 11/2002 |
| JP | 11312453 | A | 11/1999 |
| JP | 2001297683 | A | 10/2001 |

OTHER PUBLICATIONS

Written Opinion dated Apr. 19, 2011 issued in International Application No. PCT/JP2010/073885 (PCT/ISA/237).

Office Action, dated Mar. 27, 2014, issued by the State Intellectual Property Office of the People's Republic of China in counterpart Chinese Application No. 201080059190.4.

* cited by examiner

FUSIBLE LINK UNIT

CROSS REFERENCE TO RELATED APPLICATIONS

This application is based upon and claims the benefit of priority of Japanese Patent Application No. 2009-291749 filed on Dec. 24, 2009, the contents of which are incorporated herein by reference.

TECHNICAL FIELD

The present invention relates to a fusible link unit having an exposing window portion that faces a fusible portion and a resin cover which is locked thereon so as to cover the exposing window portion.

BACKGROUND ART

In FIGS. 4 (*a*) and (*b*), a fusible link unit disclosed in JP-A-2001-297683 (hereinafter PTL1) is connected to a battery of a motor vehicle to supply electric power to a load. The fusible link unit includes a conductive bus-bar 3 including a plurality of fusible portions 2 (2*a*, 2*b* to 2*e*), resin housings 4, 5 which are molded integrally with the bus-bar 3 in predetermined positions thereon and transparent resin covers 6, 7 which are locked on the resin housings 4, 5.

As portions of the bus-bar 3 that are exposed from the resin housing 4, there is a battery terminal connecting portion 8 which connects to a battery terminal, not shown, an electric wire connecting portion 10 in which a bolt 9 is provided for connection with a terminal of an end of an electric wire, not shown, and the fusible portion 2*a*. As portions of the bus-bar 3 which are exposed from the resin housing 5, there are the respective fusible portions 2*b* to 2*e* and a plurality of tab terminals 11 which connect to the load. As an additional exposed portion, there is a hinge portion denoted by reference numeral 12. The hinge portion 12 is formed as a portion which is to be folded in the position where it is provided.

The resin housings 4, 5 have exposing window portions 13, 14 for exposing the fusible portions 2*a* to 2*e*. The exposing window portion 13 is formed so as to allow the fusible portion 2*a* to be faced visibly from front and rear directions of the resin housing 4. The exposing window portion 14 is formed so as to allow the fusible portions 2*b* to 2*e* to be faced visibly from front and rear directions of the resin housing 5. These exposing window portions 13, 14 are designed to be covered with the transparent resin covers 6, 7. Locking the transparent resin covers 6, 7 on the exposing window portions 13, 14 is effected by locking projections and locking portions which are hooked on the locking projections.

Since locking the transparent resin covers 6, 7 on the exposing window portions 13, 14 is not specifically depicted in FIGS. 4(*a*) and (*b*), a complementary description will be made below by reference to FIG. 5.

Substantially claw-shaped locking projections 16 are formed at longitudinal side portions (only one of which is shown in FIG. 5) of an exposing window portion 15. A substantially frame-shaped locking portion 18 is formed at each of longitudinal side portions (only one of which is shown in FIG. 5) of a transparent resin cover 17 which covers the exposing window portion 15 described above. In this configuration, in covering the exposing window portion 15 with the transparent resin covers 17, when the locking portions 18 of the transparent resin covers 17 ride over the locking projections 16 of the exposing window portion 15 to thereby be hooked on the corresponding locking projections 16, the transparent resin covers 17 are locked on the exposing window portion 15 by the hook-like engagement of the locking portions 18 with the locking projections 16.

SUMMARY OF INVENTION

Technical Problem

In covering the exposing window portion 15 with the transparent resin covers 17, in the event that there is caused a state in which the transparent resin cover 17 is hooked on the exposing window portion 15 only at one of the longitudinal side portions, that is, a half-fitting state in which the transparent resin cover 17 is inclined as is indicated by chain double-dashed lines (a state in which the hook-like engagement of the locking projection 16 with the locking portion 18 is incomplete), there is a possibility in that the transparent resin cover 17 is easily dislodged from the exposing window portion 15 only by a light shock being given to the fusible link unit after the transparent resin cover 17 has been locked on the exposing window portion 15 in such an incomplete fashion.

While it is effective to provide a detection unit such as a height sensor to detect such a half-fitting state, this leads to a possibility in that the production costs of the fusible link unit are increased.

The present invention has been made in view of these situations and possibilities. It is an object of the present invention is to provide a fusible link unit which can prevent the occurrence of a half-fitting state. It is another object of the present invention is to provide a fusible link unit which can detect the half-fitting state without increasing the production costs.

Solution to Problem

To achieve the above objects, according to a first aspect of the present invention, there is provided a fusible link unit, comprising a conductive bus-bar including a fusible portion, a resin housing molded integrally with the bus-bar and including a locking projection and an exposing window portion for exposing the fusible portion, and a resin cover to be locked to the locking projection so as cover the fusible portion, wherein a half-fitting prevention projection is provided at a periphery of the exposing window portion.

According to a first aspect of the present invention having the features described above, in covering the exposing window portion in the resin housing with the resin cover, in a case in which the covering is carried out in the proper position, the resin cover is locked on the exposing window portion, whereby the resin cover completely fits on the exposing window portion. In a case in which the resin housing is positioned in a half-fitting position, the resin cover cannot be locked on the exposing window portion properly due to the presence of the half-fitting prevention projections. In a case in which the resin cover cannot be locked properly, the user can easily understand that he or she is placing the resin cover in the half-fitting position. According to the first aspect of the present invention, the half-fitting of the resin cover can be prevented structurally. In addition, the user can detect the half-fitting state without introduction of any detection unit.

According to a second aspect of the present invention, there is provided a fusible link unit as set forth in the first aspect of the present invention, wherein a cover guiding portion is formed on the half-fitting prevention projections for guiding the resin cover.

In the second aspect of the present invention that has the features described above, for example, when the user places the resin cover so that its orientation slightly deviates from a proper one, the resin cover is guided to the proper fitting position by the cover guiding portions to avoid the resin cover being unlocked. According to the second aspect of the present invention, the slight deviation in orientation of the resin cover can be absorbed, thereby making it possible to realize an increase in workability.

Advantageous Effects of Invention

According to the first aspect of the present invention, an advantage can be provided that the half-fitting of the resin cover can be prevented by providing the half-fitting prevention projections on the periphery of the exposing window portion. In addition, according to the first aspect of the present invention, a further advantage can be provided that the half-fitting state can be detected without increasing the cost of the fusible link unit.

According to the second aspect of the present invention, in addition to the advantages provided by the first aspect of the present invention, a further advantage can be provided that an increase in workability can be realized by forming the cover guiding portions on the half-fitting prevention projections.

DESCRIPTION OF EMBODIMENTS

Figure 1A:
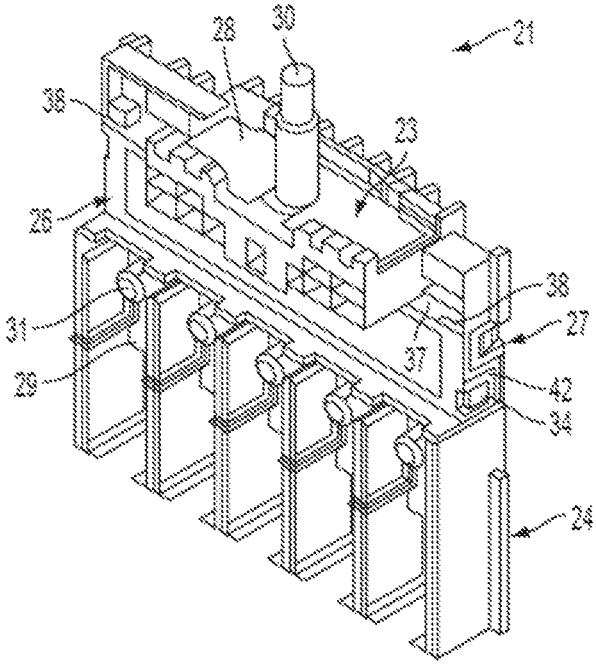
FIGS. 1 (*a*) and (*b*) show drawings depicting a fusible link unit of the present invention, in which FIG. 1(*a*) is a perspective view showing an external appearance of the fusible link unit, and FIG. 1 (*b*) is an enlarged perspective view of a main part of the fusible link unit shown in FIG. 1(*a*).
Figure 1B:
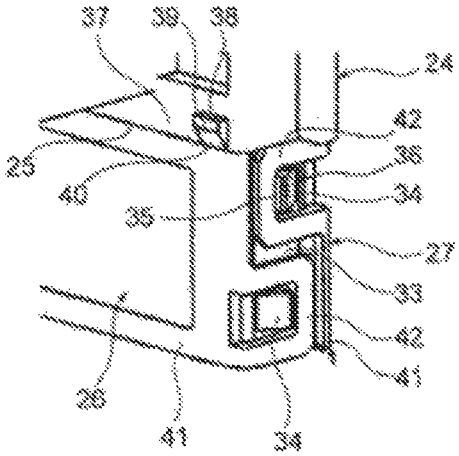
Figure 2:
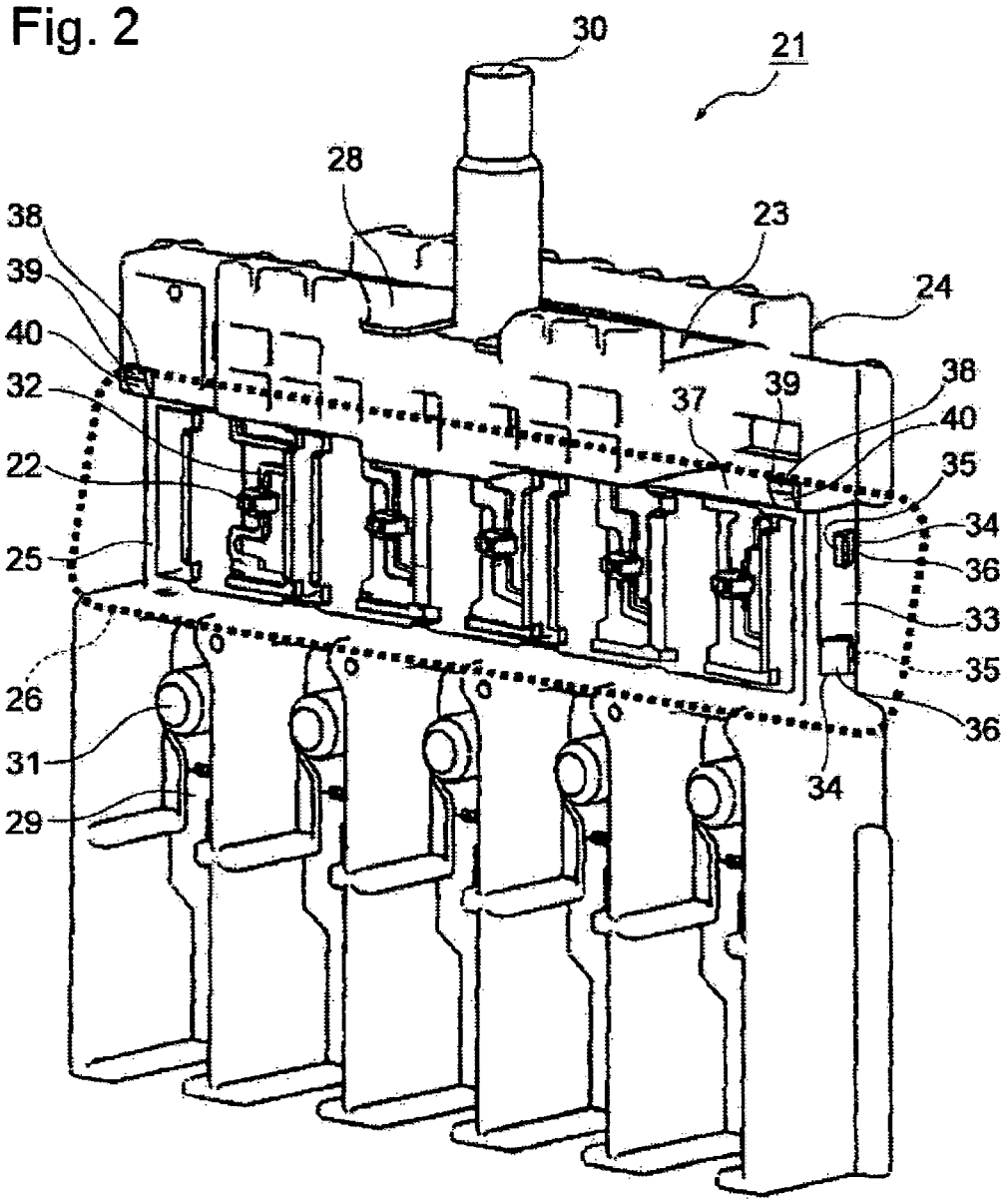
FIG. 2 is a perspective view showing fusible portions and an exposing window portion.

Hereinafter, an embodiment of the present invention will be described with reference to FIG. 1(*a*) to FIG. 3(*b*). FIGS. 1(*a*) and (*b*) are perspective views showing a fusible link unit of the invention. FIG. 2 is a perspective view showing fusible portions and an exposing window portion, and FIGS. 3 (*a*) and (*b*) show explanatory drawings depicting the function of a half-fitting prevention projection.

In FIG. 1(*a*), reference numeral 21 denotes a fusible link unit of the present invention. This fusible link unit is designed to supply electric power to a load, not shown. Although it is not limited particularly to the following configuration, the fusible link unit 21 has a portion to which a large current like one supplied from a battery of a motor vehicle is supplied and a portion which connects to the load. The fusible link unit 21 also has a portion which melts due to heat generated therein when a current flowing through the fusible link unit exceeds a predetermined level to thereby break an electric circuitry.

In this invention, the function of the fusible link unit 21 is understood to be a conventional fusible link unit, and hence, a detailed description thereof will be omitted.

In FIGS. 1 (*a*) and (*b*) and FIG. 2, the fusible link unit 21 includes a conductive bus-bar 23 that includes fusible portions 22, a resin housing 24 which is molded integrally with the bus-bar 23 in a predetermined position thereon and transparent resin covers 26, 27 which are locked to cover an exposing window portion 25 formed in the housing 24 so as to face the fusible portions 22.

The bus-bar 23 is formed into a predetermined shape by punching a sheet of conductive metal and bending a portion of the sheet of metal so punched out. In the bus-bar 23, a first connecting portion 28 is formed at one end portion, and a plurality of second connecting portions 29 are formed at the other end portion. A bolt 30 made of a conductive metal is provided at the first connecting portion 28 (provided so as to project upwards in the figure). Bolts 31 made of a conductive metal are also provided at the second connecting portions 29 (provided so as to extend to a near side of the figure).

A plurality of small width portions 32 each having a substantially crank shape, are provided in the middle of the bus-bar 23. The respective small width portions 32 are provided so as to match the number of second connecting portions 29. The fusible portion 22 is fixed to the middle of each small width portion 32 by crimping. The fusible portion 22 is a chip which is made of an alloy of tin and lead, for example, and is designed to be fused by heat generated therein when an excess current flows through the fusible element 22.

The resin housing 24 constitutes a portion which is formed of an insulating resin material by use of insert molding. An exposing widow portion 25 is provided in the resin housing 24. The exposing window portion 25 is provided in a position corresponding to the middle of the bus-bar 23 and is formed so as to face the small width portions 32 and the fusible portions 22. The exposing window portion 25 is formed so as to produce spaces on the peripheries of the fusible portions 22. The exposing window portion 25 has a parallelepiped hollow compartment shape.

Two locking projections 34 are provided at each of left and right side portions 33 of the exposing window portion 25 so as to be aligned vertically for locking the resin covers 26, 27. The locking projection 34 is a substantially claw-shaped projection and has a locking surface 35 and a guiding surface 36. In this embodiment, the lower locking projection 34 is provided as a portion which locks the resin cover 26 which is fitted from the front of the exposing window portion 25, while the upper locking projection 34 is provided as a portion which locks the resin cover 27 which is fitted from the rear of the exposing window portion 25.

Two half-fitting prevention projections 38, which constitute a feature of the present invention, are provided on a front side of the exposing window portion 25 at an upper edge portion 37, while two half-fitting prevention projections 38, which constitute the feature of the present invention, are provided on a rear side of the exposing window portion 25 at a lower edge portion (the illustration of the latter half-fitting prevention projections is to be omitted). The two half-fitting prevention projections 38 at the upper edge portion on the front side are disposed in positions which are located at the same level in height. The two half-fitting prevention projections 38 at the lower edge portion on the rear side are also disposed in positions which are located at the same level in height. The respective half-fitting prevention projections 38 are disposed in the position lying in the vicinity of an edge portion in a left-hand side corner and in the position lying in the vicinity of an edge portion in a right-hand side corner of the exposing window portion 25 (the positions and number of half-fitting prevention projections described herein are understood to constitute an example).

Although it is a substantially claw-shaped projection, each half-fitting prevention projection 38 is not a projection for locking but is formed as a projection for preventing the half-fitting of the resin covers 26, 27 on the exposing window portion 25 (the function of the half-fitting prevention projections 38 will be described later). Each half-fitting prevention projection 38 configured as described above has an apex portion 39 which constitutes a distal end of projection and a cover guiding portion 40 which is inclined towards the edge portion of the exposing window portion 35. The cover guiding portion 40 is formed to be disposed so as to connect to the apex portion 39. The cover guiding portion 40 is formed as a portion which guides the resin covers 26, 27 to a proper fitting position.

The respective half-fitting prevention positions 38 are disposed at the periphery of the exposing window portion 25 so as to be brought into contact with the corresponding resin covers 26, 27 only when the resin covers 26, 27 are in a half-fitting position.

The resin covers 26, 27 are identical to each other and are molded of a transparent, heat-resistant resin material. The resin covers 26, 27 have a substantially strip-shaped cover main body 41 and substantially frame-shaped locking portions 42 which are formed so as to be consecutive to left and right side portions of the cover main body 41. The cover main body 41 is provided as a portion which covers the exposing window portion 25. The locking portions 42 are formed as portions which are hooked on the locking projections 34 in a locking fashion. The locking portions 42 have flexibility which allows them to be opened outwards.

The locking portions 42 are configured as portions which can ride over the corresponding locking projections 34 while sliding on the guiding surfaces 36 when the resin covers 26, 27 are fitted to cover the exposing window portion 25. In addition, the locking portions 42 are configured as the portions which are hooked on the locking projections 34 in the locking fashion. When the locking portions 42 are hooked on the locking projections 34 in the locking fashion, the resin covers 26, 27 are locked on the exposing window portion 25, whereby the fitting of the resin covers 26, 27 on the exposing window portion 25 is completed.

Figure 3A:
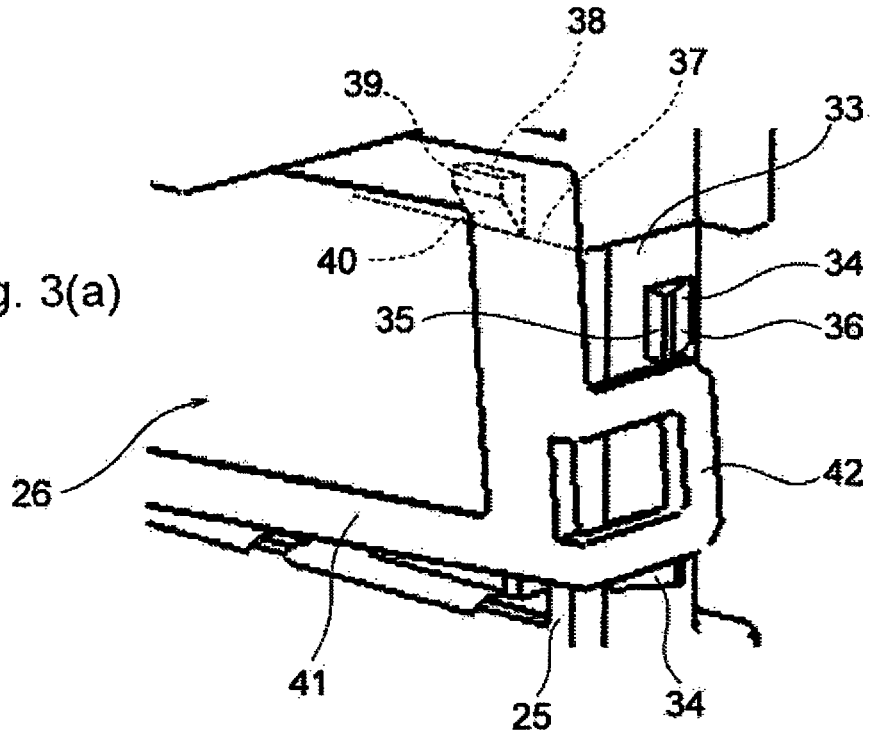
FIGS. 3 (*a*) and (*b*) show explanatory drawings depicting the function of a half-fitting prevention projection, in which FIG. 3 (*a*) is a drawing showing a state in which a resin cover is in a half-fitting position, and FIG. 3 (*b*) is a drawing showing a state in which the resin cover has been guided to a proper fitting position.
Figure 3B:
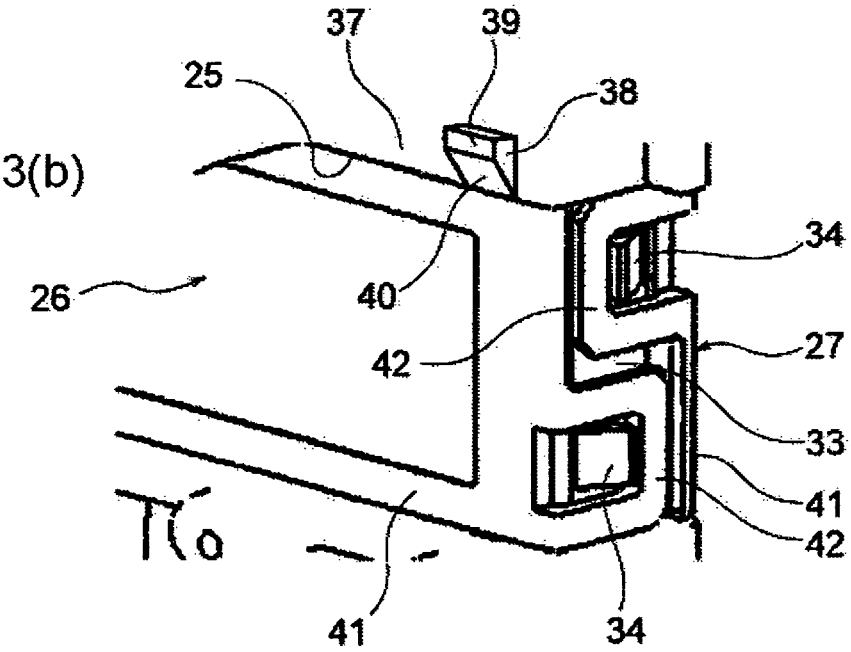
Figure 4A:
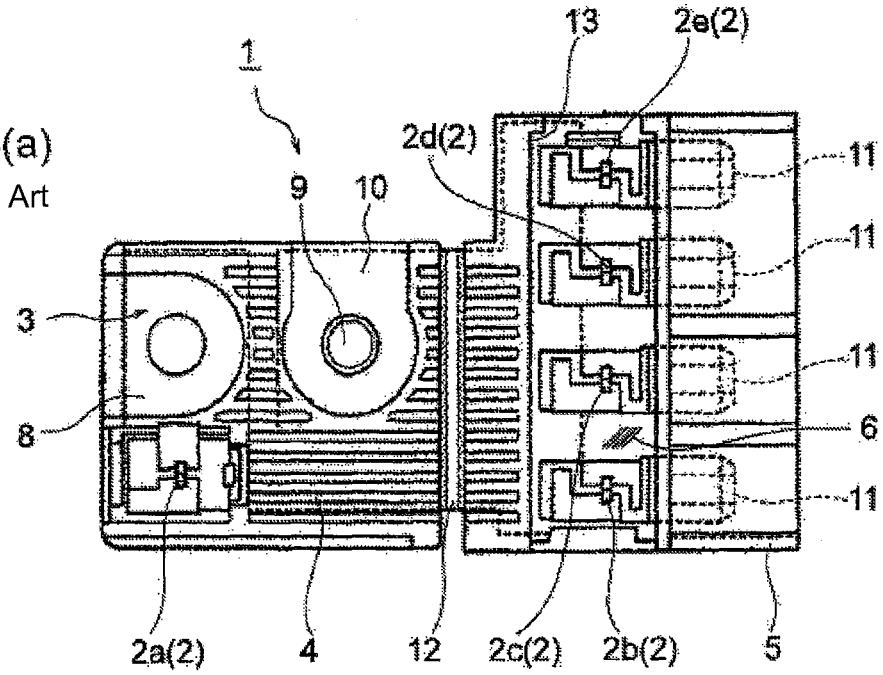
Fig. 4(a) Related Art
FIGS. 4 (*a*) and (*b*) show drawings depicting a conventional fusible link unit, in which FIG. 4 (*a*) is a plan view and FIG. 4 (*b*) is a front view of the conventional fusible link unit.
Figure 4B:
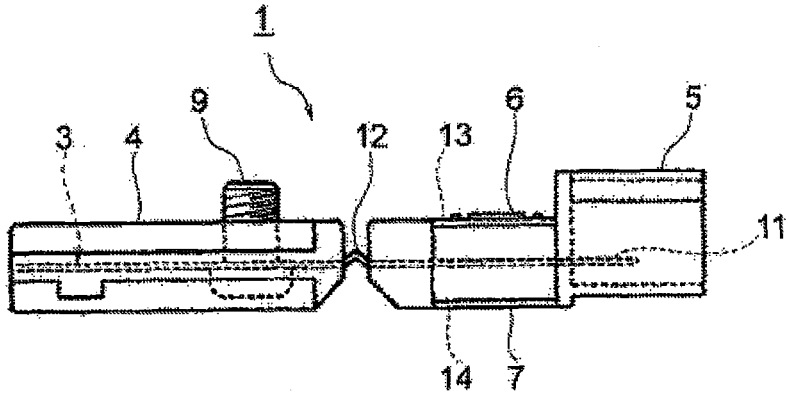
Fig. 4(b) Related Art
Figure 5:
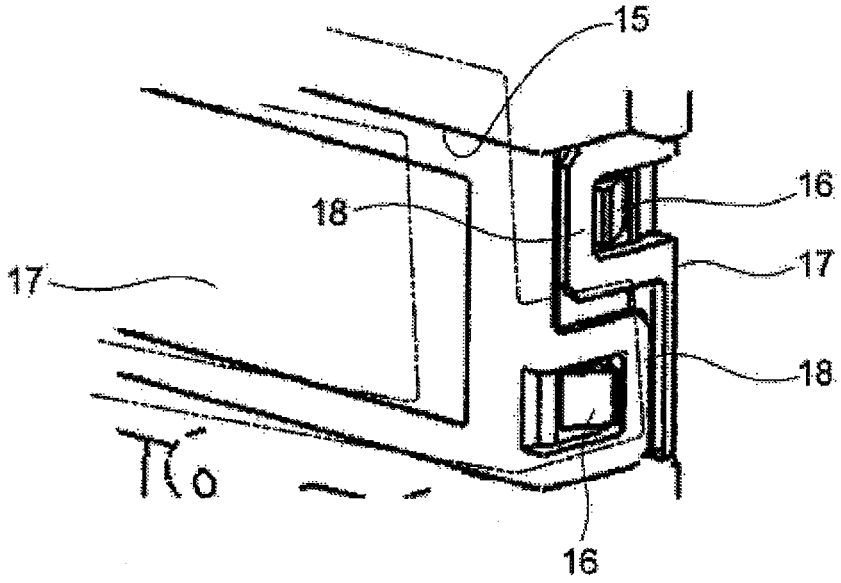
Fig.5 Related Art
FIG. 5 shows a drawing depicting how to lock the resin cover, in which a solid line depicts a state in which the resin cover is locked in the proper fitting position and a two-dot chain line depicts a state in which the resin housing is locked incompletely in a half-fitting state.

In the configuration described above, in a case in which the resin cover 26 is placed so as to deviate relatively largely from its proper fitting position as is indicated by a broken line in FIG. 2, the resin cover 26 is unable to be locked properly as is shown in FIG. 3(*a*) due to the presence of the half-fitting prevention projection 38. Namely, a position at an upper edge portion of the cover main body 41 which lies in the vicinity of a right-hand side corner thereof rides on the half-fitting prevention projection 38 (the apex portion 39), and the locking portion 42 is prevented from being hooked on the locking projection 34 as a result of the cover main body 41 riding on the half-fitting prevention projection 38 in the way described above. Thus, the resin cover 26 is unable to be locked on the exposing window portion 25. In a case in which the resin cover 26 is unable to be locked properly, the user can easily understand that he or she is placing the resin cover 26 in the half-fitting position. Therefore, in a case in which the user replaces the resin cover 26 so as to correct the deviation thereof, the resin cover 26 is fitted on the exposing window portion 25 in the proper fitting position as shown in FIG. 3(*b*).

In the present invention, since the half-fitting prevention projection 38 has the cover guiding portion 40, in the event that the user places the resin cover 26 so that the orientation thereof deviates slightly from the proper orientation, for example, the half-fitting prevention projection 38 functions as below. Namely, with a slight deviation in orientation of the resin cover 26, it can be avoided that the resin cover 26 becomes unable to be locked on the exposing window portion 25, and the resin cover 26 is guided to the proper fitting position by the inclination of the cover guiding portion 40, such that the resin cover 26 is fitted on the exposing window portion 25 in the proper fitting position as shown in FIG. 3(*b*).

Thus, as has been described heretofore with reference to FIGS. 1 (*a*) to 3(*b*), according to the present invention, by providing the half-fitting prevention projections 38 on the periphery of the exposing window portion 25, the half-fitting state can be detected without providing a detection unit such as a height sensor. Consequently, according to the present invention, an advantage can be provided that the half-fitting of the resin covers 26, 27 can be prevented while suppressing an increase in the cost of the fusible link unit.

The present invention can, of course, be carried out in various ways without departing from the spirit and scope of the invention.

REFERENCE SIGN LIST

21 fusible link unit;
22 fusible portion;
23 bus-bar;
24 resin housing;
25 exposing window portion;
26, 27 resin cover;
28 first connecting portion;
29 second connecting portion;
30, 31 bolt;
32 small width portion;
33 side portion;
34 locking projection;
35 locking surface;
36 guiding surface;
37 upper edge portion;
38 half-fitting prevention projection;
39 apex portion;
40 cover guiding portion;
41 cover main body;
42 locking portion.

The invention claimed is:

1. A fusible link unit, comprising:

a conductive bus-bar including a fusible portion;

a resin housing molded integrally with the bus-bar and including a locking projection and an exposing window portion for exposing the fusible portion; and a resin cover to be locked to the locking projection so as cover the fusible portion;

wherein a half-fitting prevention projection is provided at a periphery of the exposing window portion, wherein an inclined cover guiding portion is formed on the half-fitting prevention projection for guiding the resin cover into a proper fitting position, the inclined cover guiding portion is inclined toward an edge portion of the exposing window portion.

* * * * *